United States Patent [19]

Cusick et al.

[11] 4,110,576

[45] Aug. 29, 1978

[54] PRESSURE RESPONSIVE SWITCH

[75] Inventors: Richard T. Cusick, Laurel; Wilbur J. Fleagle, Columbia, both of Md.

[73] Assignee: The United States of America as represented by the Secretary of the Navy, Washington, D.C.

[21] Appl. No.: 833,799

[22] Filed: Sep. 16, 1977

[51] Int. Cl.[2] ..... H01H 35/38

[52] U.S. Cl. ..... 200/82 E; 200/82 R

[58] Field of Search ..... 335/205; 340/229, 240; 200/82 A, 82 R, 82 E, 81.9 M, 81 R, 83 L

[56] References Cited

U.S. PATENT DOCUMENTS

| | | | |
|---|---|---|---|
| 3,171,916 | 3/1965 | Solski | 200/82 R |
| 3,366,758 | 1/1968 | Bentzen | 200/82 E |
| 3,441,694 | 4/1969 | Vannatter | 200/82 R |
| 3,872,268 | 3/1975 | Hata | 200/82 R |

*Primary Examiner*—Gerald P. Tolin

[57] ABSTRACT

A pressure-responsive mechanical switch for use in conjunction with integral rocket-ramjet engines. The switch may only be activated when two pressure sources acting thereon meet certain preselected conditions and includes a pair of selectively interlocking pistons mounted within a pair of bores disposed in a housing. The pistons are independently acted upon by the forces produced by pressure sources to effect activation of the switch.

9 Claims, 2 Drawing Figures

PRESSURE RESPONSIVE SWITCH

BACKGROUND OF THE INVENTION

1. Field of the Invention

The present invention relates to pressure responsive switches, and more particularly, to a pressure responsive mechanical switch which may only be activated when certain preselected pressure conditions are met.

2. Description of the Prior Art

The operation of an integral rocket-ramjet engine on a high speed vehicle is characterized by a first rocket propulsion phase which boosts the vehicle to ramjet operating speed. The second phase of operation is a transitional phase which is preparatory for a third phase. During the third phase of operation, the vehicle is operated as a ramjet, with air being taken in from the external atmosphere via air inlet ports located on the forward position of the vehicle structure. However, prior to ramjet operation, during the rocket propulsion phase, these forward ports are sealed shut by port covers.

During the transitional phase between the rocket propulsion phase and the ramjet phase, explosive squibs are detonated which blow the port covers out of the forward ports thereby allowing air to flow into the ramjet combustion chamber. Detonation of these squibs occurs after pressure within the rocket fuel chamber has decreased due to consumption of the rocket fuel and when pressure increases within the air inlets due to increased speed of the vehicle.

Presently, this is accomplished by sensors which are disposed to monitor the salient pressure conditions. The sensors are coupled to electronic logic circuitry which in turn is coupled to a squib detonation circuit. The logic and sensor systems are relatively expensive, must be coupled to an external power source, and are subject to failure resultant to inadvertent damage inflicted upon the delicate electronic components thereof.

The present invention overcomes the problem associated with the prior art by providing a pressure-responsive mechanical switch which is durable, relatively inexpensive to manufacture, and which does not require an external power source.

SUMMARY OF THE INVENTION

Therefore, a primary object of the present invention is to provide a pressure-responsive mechanical switch which can be employed to discretely sense two different pressure conditions.

A further object of the present invention is to provide a pressure-responsive mechanical switch which may only be activated when two preselected pressure conditions are met.

A still further object of the present invention is to provide a pressure-responsive mechanical switch which is ideally suited for employment in integral rocket-ramjet vehicles during the transitional phase thereof, e.g. to initiate blow-off of the ramjet air inlet covers.

Still another object of the present invention is to provide a pressure-responsive mechanical switch which may be adjusted to sense various pressure levels and rates of change of pressure levels for activation.

Another object of the present invention is to provide a pressure-responsive mechanical switch which is simple in design, inexpensive to manufacture, and efficient in operation.

These objects, as well as further objects and advantages, of the present invention will become readily apparent after reading the description of a non-limiting illustrative embodiment and the accompanying drawing.

A pressure responsive switch apparatus is provided which is precluded from activation when a first source of pressure producing forces acting thereon is stabilized and which is activated when the first source of pressure produces a change of forces acting thereon followed by the first source of pressure and a second source of pressure producing forces acting on the apparatus in a preselected relationship. The switch apparatus according to the principles of the present invention includes a housing having a chamber disposed therein, a first bore disposed in the housing and communicating with the chamber, a second bore disposed in the housing and communicating with the first bore; a first elongated piston slidably disposed within the first bore, a first end of the first piston movable in the chamber; a second elongated piston slidably disposed within the second bore and extendible into the first bore; means responsive to movement of the second piston for positively engaging and locking the first piston in a preselected position; means for retracting the second piston to disengage the first piston, the retraction means acting in response to a change in pressure within the chamber delivered thereto by the first source of pressure; switch means disposed within the housing adjacent to the first end of the first piston; and means for urging the first piston from the preselected position to a position for activating the switch means responsive to the forces produced by the second source of pressure acting upon the second end of the first piston and the forces produced by the first source of pressure acting simultaneously upon the first end thereof.

BRIEF DESCRIPTION OF THE DRAWING

In order that the present invention may be more fully understood it will now be described, by way of example, with reference to the accompanying drawing in which.

DESCRIPTION OF THE PREFERRED EMBODIMENT

Figure 1:
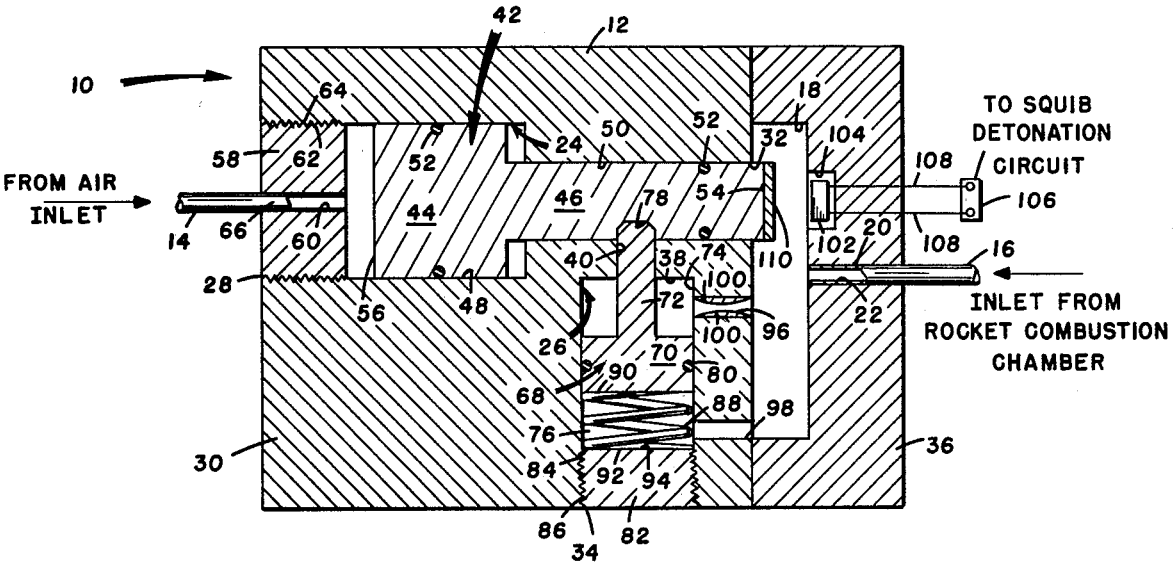
FIG. 1 is a cross-sectional view of the preferred embodiment incorporating the principle of the present invention therein in a deactivated mode.
Figure 2:
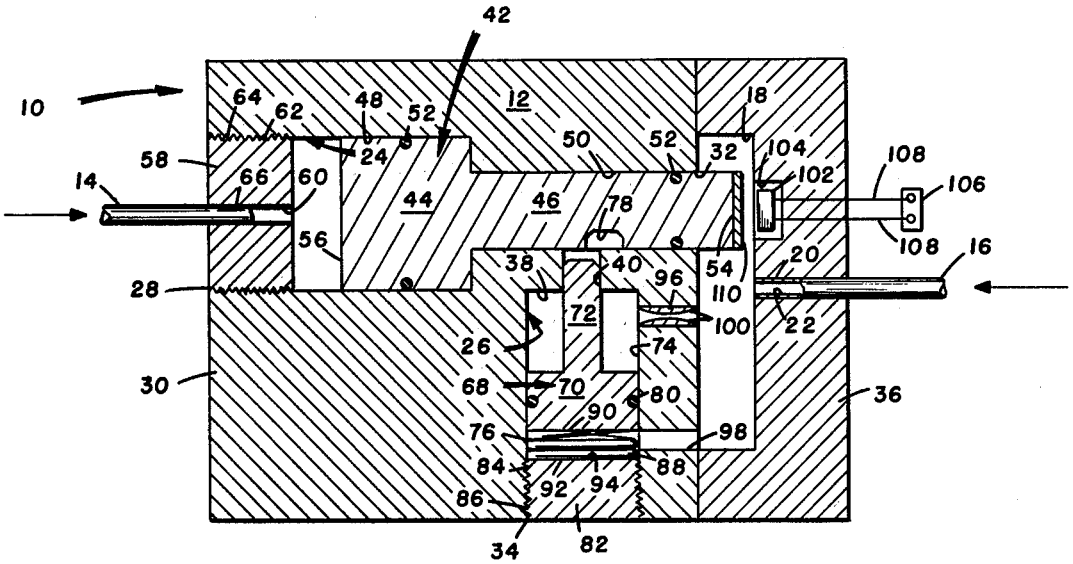
FIG. 2 is a cross-sectional view of the preferred embodiment in an activated mode.

Referring now to the figures, and more particularly to FIG. 1 thereof, there is illustrated a pressure responsive switch apparatus 10 which includes a housing 12. The pressure responsive switch apparatus 10 may be used in conjunction with a squib detonation circuit of an integral rocket-ramjet engine incorporated in a flight vehicle or the like, not illustrated, to detonate the squibs which thereby blow out port covers during the transitional phase between the rocket propulsion phase and the ramjet phase of the engine. If the switch apparatus 10 is employed in such an application, the air inlet of the integral rocket-ramjet engine would be connected to the switch apparatus 10 through a tube 14 as hereinafter described. Similarly, the rocket combustion chamber would be connected to the apparatus 10 through a tube 16.

The housing 12 may be constructed of any suitable material such as aluminum or the like having similar strength characteristics and has a chamber 18 disposed therein. The end portion 20 of the tube 16 is fixedly secured within an elongated aperture 22 in communication with the chamber 18 thereby permitting delivery of pressure from the rocket combustion chamber thereto.

A first elongated open-ended bore 24 and a second elongated open-ended bore 26 are each disposed within the housing 12 in a substantially perpendicular relationship. One end 28 of the first bore 24 opens through an outer surface 30 of the housing 12 with the other end 32 thereof opening into the chamber 18. One end 34 of the second elongated open-ended bore 26 opens through an outer surface 36 of the housing 12 with the other end 38 thereof being in communication and coaxially aligned with a shank aperture 40 disposed within the housing 12. In turn, the shank aperture 40 opens into the first bore 24.

A first piston 42 is slidably disposed within the first bore 24 and provides a head portion 44 and a shank portion 46 having a smaller cross-sectional area than that of the head portion 44. The first bore 24 provides a portion 48 for accommodating the head portion 44 of the piston 42 and a portion 50 for accommodating the shank portion 46 thereof. The head and shank portions 44 and 46 incorporate "O" rings 52, mounted in a conventional manner to isolate the first bore 24 from the second bore 26 and the chamber 18. Although "O" rings are employed, any suitable sealing means may be substituted. The first piston 42 and the first bore 24 are oriented so that a first end 54 of the first piston 42 is disposed adjacent to the end 32 of the bore 24 and the second end 56 of the piston 42 is disposed adjacent to the end 28 of the bore 24, with the first end 54 and a section of the shank portion 46 being movable within the chamber 18.

A plug 58 having an aperture 60 disposed therethrough and external threads 62 disposed therearound is threadably positioned within the first bore 24 adjacent to the end 28 thereof with internal threads 64 provided by the bore 24 threadably engaging the external threads 62. The plug 58 can be unthreaded from the first bore 24 so that the first piston 42 can be inserted therein during assembly of the switch assembly 10. The end portion 66 of the tube 14 is fixedly secured within the aperture 60 of the plug 58, by suitable means, thereby permitting delivery of pressure from the air inlet to enter the first bore 24 and to act upon the second end 56 of the first piston 42.

A second piston 68 is slidably disposed within the second bore 26 and includes a head portion 70 and a shank portion 72. The head portion 70 divides the second bore 26 into a first cavity 74 and a second cavity 76 with the piston being disposed so that the shank portion 72 thereof extends through the shank aperture 40 and may be received within a capturing aperture 78 located in the shank portion 46 of the first piston 42. An "O" ring 80 is positioned about the circumference of the head portion 70 in a conventional manner to isolate the front cavity 74 from the rear cavity 76.

A plug 82 having external threads 84 threadably cooperating with internal threads 86 located in the second bore 26 is disposed within the second bore 26 adjacent to the end 34 thereof.

A helical compression spring 88 is disposed within the rear cavity 76 and has one end 90 thereof in contact with the head portion 70 and the other end 92 thereof in contact with the inner surface 94 of the plug 82. The force of the spring 88 is such that the second piston 68 is urged toward the first piston 42 thereby permitting engagement of the capturing aperture 78 by the shank portion 72 of the second piston 68 if the first piston 42 is positioned as illustrated in FIG. 1. Although a spring is described and illustrated for urging the second piston 68, any suitable biasing means may be employed.

A first passage 96 is disposed within the housing 12 and connects the first cavity 74 with the chamber 18. A second passage 98, also disposed within the housing 12, connects the second cavity 76 and the chamber 18. The first passage 96 is constricted relative to the second passage 98 by a partial obstruction 100 as illustrated. Alternately, a valve, nozzle or other suitable means may be employed instead of the obstruction 100 to constrict the flow through either the first passage 96 or the second passage 98 relative to each other.

An encapsulated reed contact assembly 102 of a magnetic reed switch is mounted within a switch cavity 104 adjacent to the chamber 18 and the first end 54 of the first piston 42. The assembly 102 is connected to a terminal block 106 by a pair of insulated conductors 108. A magnetized element 110 is fixedly secured to the first end 54 of the first piston 42. When the magnetized element 110 is brought close enough to the reed contact assembly 102, the terminals on the terminal block 106 are shorted together. If the switch apparatus 10 is employed in an integral rocket ramjet engine, the terminals would be connected to the squib detonator circuit thereof. Although a magnetic reed switch is described herein, other suitable types and configurations of switches may be substituted therefor by one skilled in the art.

In operation, the first piston 42 is positioned so that the shank portion 72 of the second piston 68 may engage the capturing aperture 78 to positively lock the first piston 42 in place. During the rocket propulsion phase of the vehicle, not illustrated, pressure within the chamber 18 builds up since it is delivered by way of the tube 16 through the aperture 22. At this time, pressure within the first bore 24 delivered thereto through the aperture 60 by way of the tube 14, is minimal since the vehicle has just begun to accelerate.

Pressure within the chamber 18 simultaneously passes through the first and second discrete passages 96 and 98 respectively, into the first and second cavities 74 and 76. Since the first passage 96 is constricted by the partial obstruction 100, pressure builds up faster within the second cavity 76 than within the first cavity 74 thereby urging and maintaining the second piston 68 in an interlocked position with the first piston 42. When the rocket fuel within the rocket combustion chamber is consumed, the pressure within the chamber 18 begins to decrease. Simultaneously, the pressure within the first and second cavities 74 and 76 begins to drop. Since the first passage 96 is constricted relative to the second passage 98, pressure within the second cavity 76 drops faster than the pressure within the first cavity 74 causing an unbalanced force which acts against the spring 88 to retract the shank portion 72 of the second piston 68 from the capturing aperture 78 located in the first piston 44. Once the second piston 68 retracts as hereinabove described, the first piston 42 is unlocked and is free for movement. Pressure within the first bore 24 has increased due to the increased speed of the vehicle resultant of the burning of the rocket fuel. When pressures within the chamber 18 and the first bore 24 are approximately equal, the first piston 42 is urged toward the reed contact assembly 102 since the surface area of the end 56 of first piston 42 is greater than the surface area of the end 54 thereby causing a resultant unbalanced force. Approach of the magnetized element 110 toward the reed contact assembly 102 closes the magnetic reed switch which shorts the terminals in the terminal block 106 thereby activating the squib detonation circuit connected thereto. Explosion of the squibs causes the port covers to be blown out thereby allowing air to flow into the vehicle for ramjet operation.

The pressure requirements which cause movement of the second piston can be set at a preselected level during manufacture by varying of the constriction of the first passage 96 in relation to the second passage 98, and by the spring constant of the compression spring 88. In addition, the force of the spring 88 may be varied by the exact placement of the plug 82 within the second bore 74. The pressure requirements which cause movement of the first piston 42 may be preselected during manufacture by varying of the ratio of the surface areas of the ends 54 and 56 thereof.

Although the pressure responsive switch 10 of the present invention has been described in use with an integral rocket ramjet vehicle, it should be apparent to one skilled in the art that the teachings of the present invention may be applied to other applications where similar pressure conditions and requirements exist.

It will be understood that various changes in the details, materials, arrangement of parts, and operation conditions which have been herein described and illustrated in order to explain the nature of the invention may be made by those skilled in the art within the principles and scope of the invention.

Having thus set forth the nature of the invention, what is claimed is:

1. A pressure responsive switch apparatus which is precluded from activation when a first source of pressure producing forces acting thereon is stabilized and which is activated when said first source of pressure produces a change of forces acting thereon followed by said first source of pressure and a second source of pressure producing forces acting on said apparatus in a preselected relationship, said apparatus comprising:

a housing having a chamber disposed therein, a first bore being disposed in said housing and communicating with said chamber, a second bore being disposed in said housing and communicating with said first bore;

a first elongated piston slidably disposed within said first bore, a first end of said first piston movable in said chamber;

a second elongated piston slidably disposed within said second bore;

means extendible into said first bore and responsive to movement of said second piston for positively engaging and locking said first piston in a preselected position;

means for disengaging and unlocking said engaging and locking means, said disengaging and unlocking means acting in response to movement of said second piston caused by a change of pressure within said chamber delivered thereto by said first source of pressure;

switch means disposed within said housing adjacent to said first end of said first piston; and means for urging said first piston from said preselected position to a position for activating said switch means responsive to said forces produced by said second source of pressure acting upon the second end of said first piston and said forces produced by said first source of pressure acting simultaneously upon said first end thereof in said preselected relationship.

2. A switch apparatus in accordance with claim 1, wherein said locking and engaging means comprises an engagement aperture disposed in said first piston and a shank portion provided by said second piston, said second piston also comprising a head portion, said head portion dividing said second bore into a first cavity and a second cavity, said shank portion being extendible into said engagement aperture, and spring bias means for urging said shank into said aperture.

3. A switch apparatus in accordance with claim 2, wherein said spring bias means comprises a helical compression spring, one end of said spring contacting said head portion, a plug for movable positioning within said second bore, the other end of said helical compression spring contacting said plug.

4. A switch apparatus in accordance with claim 3, wherein said plug is movably positioned within said second bore by a plurality of internal threads disposed therein and a plurality of complementary external threads disposed on said plug.

5. A switch apparatus in accordance with claim 2, wherein said disengaging and unlocking means comprises a first passage disposed within said housing and communicating between said chamber and said first cavity and a second passage disposed within said housing and communicating between said second cavity and said chamber, one of said passages being constricted a preselected degree relative to the other of said passages.

6. A switch apparatus in accordance with claim 1, wherein said switch means comprises a magnetic reed switch including an encapsulated reed contact assembly mounted within said housing adjacent to said first end of said first piston, and a magnetized element fixedly secured to said first end of said first piston.

7. A switch apparatus in accordance with claim 1, wherein said first and second pressures are substantially equal, said urging means comprising said first end of said first piston having a surface area smaller than said second end thereof, said substantially equal pressures thereby causing a greater force acting upon said second end of said first piston than upon said first end thereof, these unbalanced forces causing movement of said first piston toward said switch means.

8. A switch apparatus in accordance with claim 1, further comprising a plug having an aperture disposed therethrough, said plug secured within said first bore adjacent to the outer end thereof, said second source of pressure delivered to said first bore by way of said aperture disposed through said plug.

9. A switch apparatus in accordance with claim 1, wherein said housing has an aperture disposed therein in communication with said chamber, said first source of pressure delivered to said chamber through said aperture.

* * * * *